US009051793B2

(12) United States Patent
Makkar et al.

(10) Patent No.: US 9,051,793 B2
(45) Date of Patent: Jun. 9, 2015

(54) APPARATUSES AND METHODS FOR STABILIZING DOWNHOLE TOOLS

(75) Inventors: Navish Makkar, Houston, TX (US); Brian Cruickshank, Montgomery, TX (US); Charles Dewey, Houston, TX (US); Michael G. Azar, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 748 days.

(21) Appl. No.: 13/324,265

(22) Filed: Dec. 13, 2011

(65) Prior Publication Data

US 2013/0146361 A1 Jun. 13, 2013

(51) Int. Cl.
*E21B 10/32* (2006.01)
*E21B 17/10* (2006.01)

(52) U.S. Cl.
CPC ..... *E21B 10/322* (2013.01); *E21B 10/32* (2013.01); *E21B 17/1078* (2013.01)

(58) Field of Classification Search
CPC ..... E21B 10/32
USPC ..... 175/263, 265, 267
See application file for complete search history.

(56) References Cited

U.S. PATENT DOCUMENTS

| | | | | |
|---|---|---|---|---|
| 2,823,901 | A * | 2/1958 | Kammerer | 166/55.8 |
| 3,224,507 | A | 12/1965 | Cordary et al. | |
| 3,331,439 | A * | 7/1967 | Sanford | 166/55.8 |
| 3,425,500 | A | 2/1969 | Fuchs | |
| 4,055,226 | A | 10/1977 | Weber | |
| 4,938,291 | A * | 7/1990 | Lynde et al. | 166/55.8 |
| 7,314,099 | B2 | 1/2008 | Dewey et al. | |
| 7,770,664 | B2 | 8/2010 | Laird et al. | |
| 7,900,717 | B2 | 3/2011 | Radford et al. | |
| 7,954,564 | B2 | 6/2011 | Makkar et al. | |
| 2010/0018779 | A1 * | 1/2010 | Makkar et al. | 175/382 |
| 2010/0276201 | A1 * | 11/2010 | Makkar et al. | 175/57 |
| 2013/0168076 | A1 * | 7/2013 | Davis | 166/55.8 |

FOREIGN PATENT DOCUMENTS

WO 2010126938 11/2010

OTHER PUBLICATIONS

International Search Report and Written Opinion of PCT/US2012/069356 dated Mar. 28, 2013: pp. 1-12.

* cited by examiner

*Primary Examiner* — Giovanna C Wright
(74) *Attorney, Agent, or Firm* — Osha Liang LLP

(57) ABSTRACT

A secondary cutting structure for use in a drilling assembly includes a tubular body, and a block, extendable from the tubular body, the block including a first arrangement of cutting elements disposed on a first blade, a first stabilization section disposed proximate the first arrangement of cutting elements, a second arrangement of cutting elements disposed on the first blade, and a second stabilization section disposed proximate the second arrangement of cutting elements. A method of drilling includes disposing a drilling assembly in a wellbore, the drilling assembly including a secondary cutting structure having a tubular body and a block, extendable from the body, the block including at least three blades, actuating the secondary cutting structure, wherein the actuating includes extending the block from the tubular body, and drilling formation with the extended block.

15 Claims, 11 Drawing Sheets

APPARATUSES AND METHODS FOR STABILIZING DOWNHOLE TOOLS

BACKGROUND

1. Field of the Invention

Embodiments disclosed herein relate to apparatuses and methods for drilling formation. More specifically, embodiments disclosed herein relate to apparatuses and methods for drilling formation with drilling tool assemblies having enhanced stabilizing features. More specifically still, embodiments disclosed herein relate to apparatuses and methods for drilling formation with expandable secondary cutting structure having enhanced stabilizing features.

2. Background Art

FIG. 1A shows one example of a conventional drilling system for drilling an earth formation. The drilling system includes a drilling rig 10 used to turn a drilling tool assembly 12 that extends downward into a well bore 14. The drilling tool assembly 12 includes a drilling string 16, and a bottom-hole assembly (BHA) 18, which is attached to the distal end of the drill string 16. The "distal end" of the drill string is the end furthest from the drilling rig.

The drill string 16 includes several joints of drill pipe 16*a* connected end to end through tool joints 16*b*. The drill string 16 is used to transmit drilling fluid (through its hollow core) and to transmit rotational power from the drill rig 10 to the BHA 18. In some cases the drill string 16 further includes additional components such as subs, pup joints, etc.

The BHA 18 includes at least a drill bit 20. Typical BHA's may also include additional components attached between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems. In certain BHA designs, the BHA may include a drill bit 20 or at least one secondary cutting structure or both.

In general, drilling tool assemblies 12 may include other drilling components and accessories, such as special valves, kelly cocks, blowout preventers, and safety valves. Additional components included in a drilling tool assembly 12 may be considered a part of the drill string 16 or a part of the BHA 18 depending on their locations in the drilling tool assembly 12.

The drill bit 20 in the BHA 18 may be any type of drill bit suitable for drilling earth formation. Two common types of drill bits used for drilling earth formations are fixed-cutter (or fixed-head) bits and roller cone bits.

In the drilling of oil and gas wells, concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through an existing cased borehole and enlarging the borehole below the casing. One such method is the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is typically used in conjunction with a conventional pilot drill bit positioned below or downstream of the underreamer. The pilot bit can drill the borehole at the same time as the underreamer enlarges the borehole formed by the bit. Underreamers of this type usually have hinged arms with roller cone cutters attached thereto. Most of the prior art underreamers utilize swing out cutter arms that are pivoted at an end opposite the cutting end of the cutting arms, and the cutter arms are actuated by mechanical or hydraulic forces acting on the arms to extend or retract them. Typical examples of these types of underreamers are found in U.S. Pat. Nos. 3,224,507; 3,425,500 and 4,055,226. In some designs, these pivoted arms tend to break during the drilling operation and must be removed or "fished" out of the borehole before the drilling operation can continue. The traditional underreamer tool typically has rotary cutter pocket recesses formed in the body for storing the retracted arms and roller cone cutters when the tool is in a closed state. The pocket recesses form large cavities in the underreamer body, which requires the removal of the structural metal forming the body, thereby compromising the strength and the hydraulic capacity of the underreamer. Accordingly, these prior art underreamers may not be capable of underreaming harder rock formations, or may have unacceptably slow rates of penetration, and they are not optimized for the high fluid flow rates required. The pocket recesses also tend to fill with debris from the drilling operation, which hinders collapsing of the arms. If the arms do not fully collapse, the drill string may easily hang up in the borehole when an attempt is made to remove the string from the borehole.

Recently, expandable underreamers having arms with blades that carry cutting elements have found increased use. Expandable underreamers allow a drilling operator to run the underreamer to a desired depth within a borehole, actuate the underreamer from a collapsed position to an expanded position, and enlarge a borehole to a desired diameter. Cutting elements of expandable underreamers may allow for underreaming, stabilizing, or backreaming, depending on the position and orientation of the cutting elements on the blades. Such underreaming may thereby enlarge a borehold by 15-40%, or greater, depending on the application and the specific underreamer design.

Typically, expandable underreamer design includes placing two blades in groups, referred to as blocks, around a tubular body of the tool. A first blade, referred to as a leading blade absorbs a majority of the load, the leading load, as the tool contacts formation. A second blade, referred to as a trailing blade, and positioned rotationally behind the leading blade on the tubular body then absorbs a trailing load, which is less than the leading load. Thus, the cutting elements of the leading blade traditionally bear a majority of the load, while cutting elements of the trailing blade only absorb a majority of the load after failure of the cutting elements of the leading blade. Such design principles, resulting in unbalanced load conditions on adjacent blades, often result in premature failure of cutting elements, blades, and subsequently, the underreamer.

Accordingly, there exists a need for apparatuses and methods of drilling formation having enhanced vibration control.

SUMMARY OF THE DISCLOSURE

In one aspect, embodiments disclosed herein relate to a secondary cutting structure for use in a drilling assembly, the secondary cutting structure including a tubular body, and a block, extendable from the tubular body, the block including a first arrangement of cutting elements disposed on a first blade, a first stabilization section disposed proximate the first arrangement of cutting elements, a second arrangement of cutting elements disposed on the first blade, and a second stabilization section disposed proximate the second arrangement of cutting elements.

In another aspect, embodiments disclosed herein relate to a secondary cutting structure for use in a drilling assembly, the secondary cutting structure including a tubular body, and a block, extendable from the tubular body, the block including a plurality of cutting elements disposed on a first blade, and at least one depth of cut limiter disposed intermediate the apex of at least two adjacent cuttings element.

In another aspect, embodiments disclosed herein relate to a secondary cutting structure for use in a drilling assembly, the secondary cutting structure including a tubular body, and a block, extendable from the tubular body, the block including at least three blades.

In yet another aspect, embodiments disclosed herein relate to a method of drilling, the method including disposing a drilling assembly in a wellbore, the drilling assembly including a secondary cutting structure having a tubular body and a block, extendable from the body, the block including at least three blades, actuating the secondary cutting structure, wherein the actuating includes extending the block from the tubular body, and drilling formation with the extended block.

Other aspects and advantages of the invention will be apparent from the following description and the appended claims.

DETAILED DESCRIPTION

In one aspect, embodiments disclosed herein relate generally to apparatuses and methods for drilling formation. In another aspect, embodiments disclosed herein relate to apparatuses and methods for drilling formation with drilling tool assemblies having enhanced stabilizing features. In yet another aspect, embodiments disclosed herein relate to apparatuses and methods for drilling formation with expandable secondary cutting structure having enhanced stabilizing features.

Secondary cutting structures, according to embodiments disclosed herein, may include reaming devices of a drilling tool assembly capable of drilling an earth formation. Such secondary cutting structures may be disposed on a drill string downhole tool and actuated to underream or backream a wellbore. Examples of secondary cutting structures include expandable reaming tools that are disposed in the wellbore in a collapsed position and then expanded upon actuation.

Figure 1A:
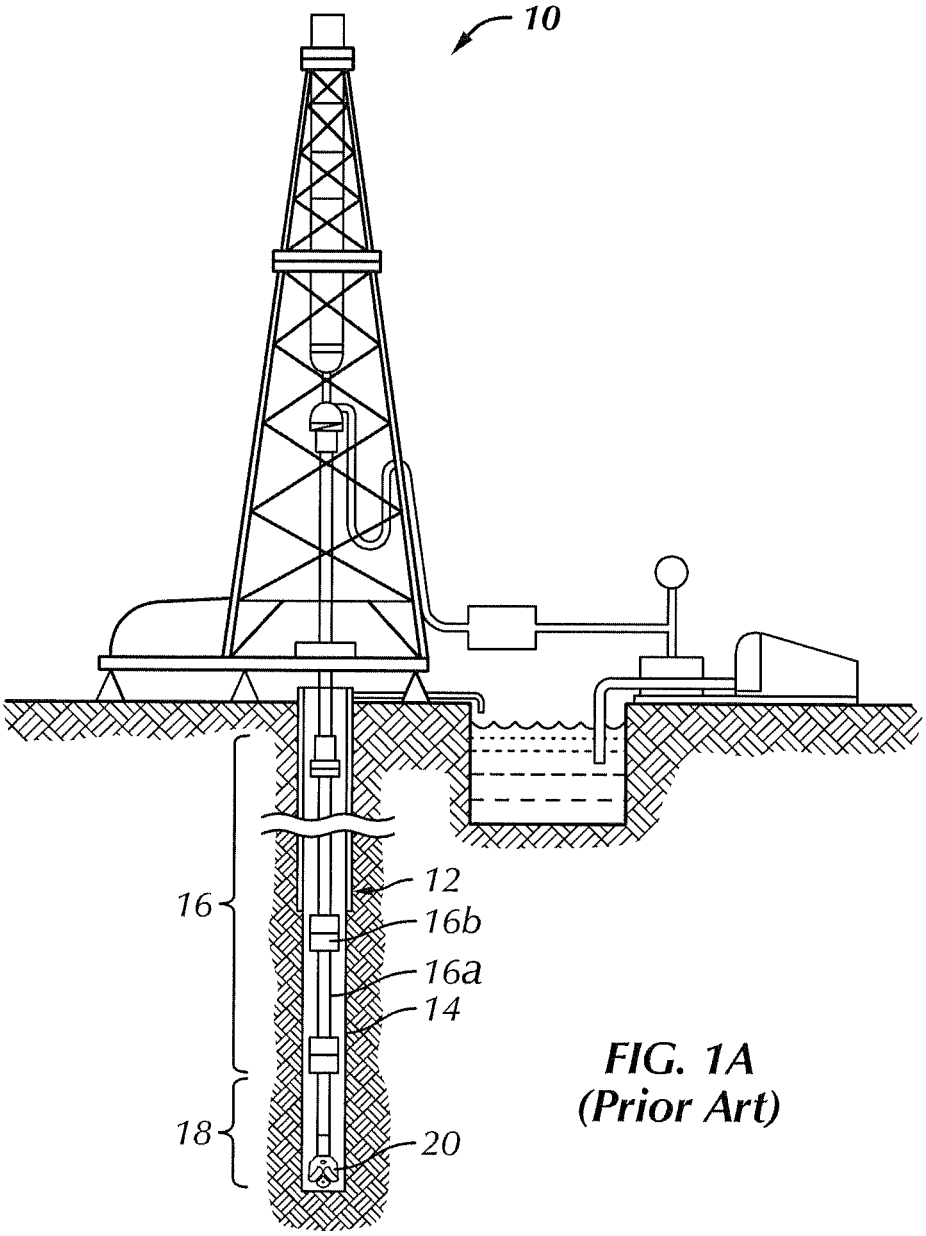
FIG. 1A (Prior Art)
FIG. 1A is a schematic representation of a drilling operation.
Figure 1B:
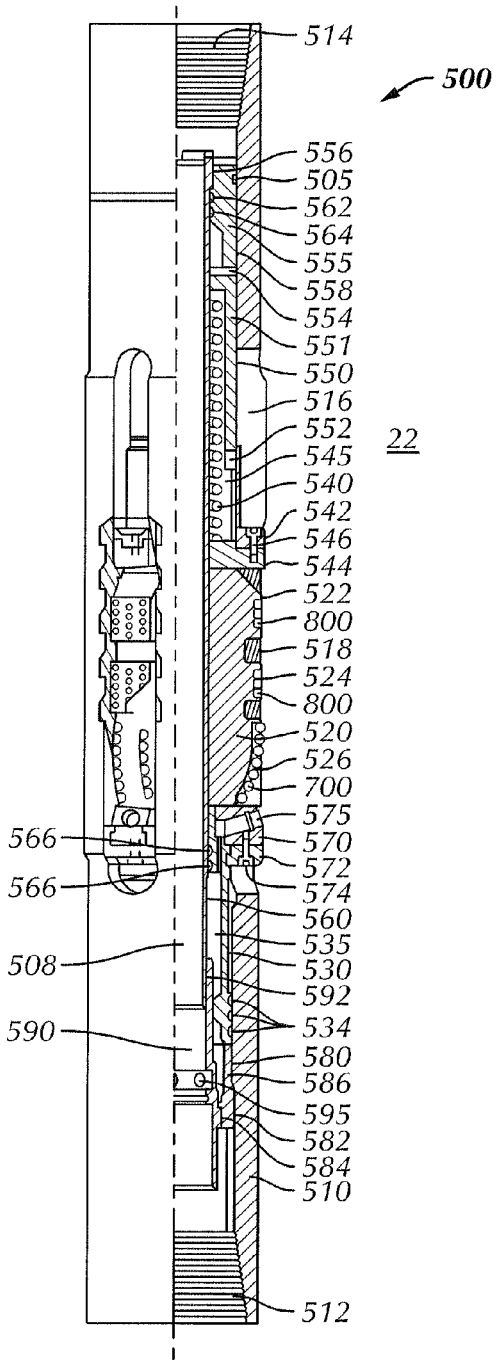
FIGS. 1B and 1C are partial cut away views of an expandable secondary cutting structure.
Figure 1C:
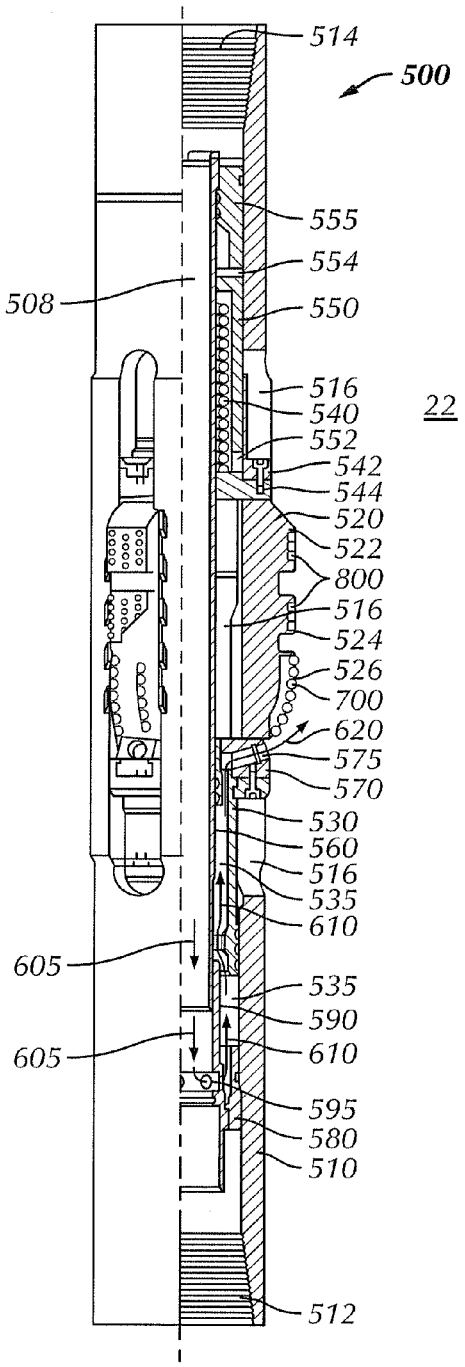

Referring now to FIGS. 1B and 1C, an expandable tool, which may be used in embodiments of the present disclosure, generally designated as 500, is shown in a collapsed position in FIG. 1B and in an expanded position in FIG. 1C. The expandable tool 500 comprises a generally cylindrical tubular tool body 510 with a flowbore 508 extending therethrough. The tool body 510 includes upper 514 and lower 512 connection portions for connecting the tool 500 into a drilling assembly. In approximately the axial center of the tool body 510, one or more pocket recesses 516 are formed in the body 510 and spaced apart azimuthally around the circumference of the body 510. The one or more recesses 516 accommodate the axial movement of several components of the tool 500 that move up or down within the pocket recesses 516, including one or more moveable, non-pivotable tool arms 520. Each recess 516 stores one moveable arm 520 in the collapsed position.

FIG. 1C depicts the tool 500 with the moveable arms 520 in the maximum expanded position, extending radially outwardly from the body 510. Once the tool 500 is in the borehole, it is only expandable to one position. Therefore, the tool 500 has two operational positions—namely a collapsed position as shown in FIG. 1B and an expanded position as shown in FIG. 1C. However, the spring retainer 550, which is a threaded sleeve, may be adjusted at the surface to limit the full diameter expansion of arms 520. Spring retainer 550 compresses the biasing spring 540 when the tool 500 is collapsed, and the position of the spring retainer 550 determines the amount of expansion of the arms 520. Spring retainer 550 is adjusted by a wrench in the wrench slot 554 that rotates the spring retainer 550 axially downwardly or upwardly with respect to the body 510 at threads 551.

In the expanded position shown in FIG. 1C, the arms 520 will either underream the borehole or stabilize the drilling assembly, depending on the configuration of pads 522, 524 and 526. In FIG. 1C, cutting structures 700 on pads 526 are configured to underream the borehole. Depth of cut limiters (i.e., depth control elements) 800 on pads 522 and 524 would provide gauge protection as the underreaming progresses. Hydraulic force causes the arms 520 to expand outwardly to the position shown in FIG. 1C due to the differential pressure of the drilling fluid between the flowbore 508 and the annulus 22.

The drilling fluid flows along path 605, through ports 595 in the lower retainer 590, along path 610 into the piston chamber 535. The differential pressure between the fluid in the flowbore 508 and the fluid in the borehole annulus 22 surrounding tool 500 causes the piston 530 to move axially upwardly from the position shown in FIG. 1B to the position shown in FIG. 1C. A small amount of flow can move through the piston chamber 535 and through nozzles 575 to the annulus 22 as the tool 500 starts to expand. As the piston 530 moves axially upwardly in pocket recesses 516, the piston 530 engages the drive ring 570, thereby causing the drive ring 570 to move axially upwardly against the moveable arms 520. The arms 520 will move axially upwardly in pocket recesses 516 and also radially outwardly as the arms 520 travel in channels 518 disposed in the body 510. In the expanded position, the flow continues along paths 605, 610 and out into the annulus 22 through nozzles 575. Because the nozzles 575 are part of the drive ring 570, they move axially with the arms 520. Accordingly, these nozzles 575 are optimally positioned to continuously provide cleaning and cooling to the cutting structures 700 disposed on surface 526 as fluid exits to the annulus 22 along flow path 620.

The underreamer tool 500 may be designed to remain concentrically disposed within the borehole. In particular, the tool 500 in one embodiment preferably includes three extendable arms 520 spaced apart circumferentially at the same axial location on the tool 510. In one embodiment, the circumferential spacing would be approximately 120 degrees apart. This three-arm design provides a full gauge underreaming tool 500 that remains centralized in the borehole. While a three-arm design is illustrated, those of ordinary skill in the art will appreciate that in other embodiments, tool 510 may include different configurations of circumferentially spaced arms, for example, less than three-arms, four-arms, five-arms, or more than five-arm designs. Thus, in specific embodiments, the circumferential spacing of the arms may vary from the 120-degree spacing illustrated herein. For example, in alternate embodiments, the circumferential spacing may be 90 degrees, 60 degrees, or be spaced in non-equal increments. Accordingly, the secondary cutting structure designs disclosed herein may be used with any secondary cutting structure tools known in the art.

Figure 2:
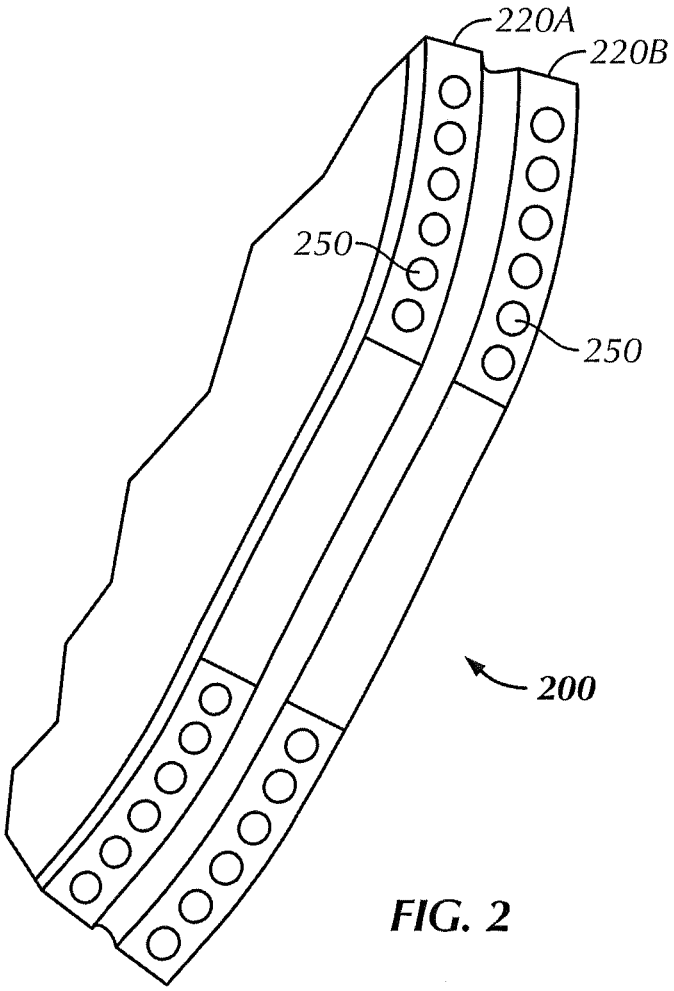
FIG. 2 is a side perspective view of a block of a reamer.

Referring to FIG. 2, a perspective view of a block according to embodiments of the present disclosure is shown. In this embodiment, a cutter block 200 is shown having two blades 220A and 220B, with a plurality of inserts 250 disposed on the blades 220A and 220B. As explained above, the block 200 having blades 220 carrying inserts 250 may be expanded when disposed in the wellbore, thereby allowing the inserts 250 to contact formation during, for example, reaming operations.

Figure 3:
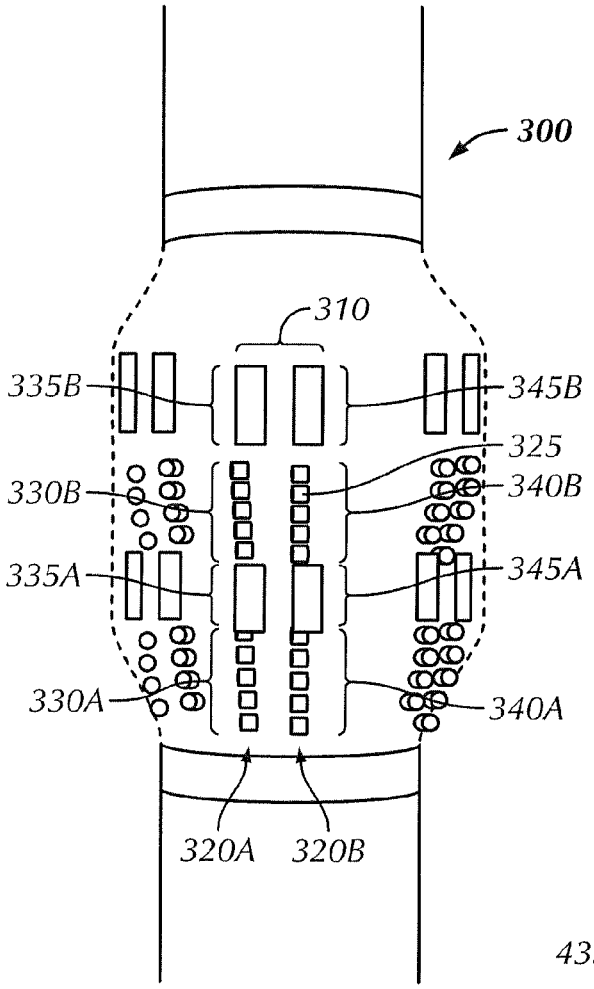
FIG. 3 is a side view of a reamer according to embodiments of the present disclosure.

Referring to FIG. 3, a perspective view of a reamer 300 according to embodiments of the present disclosure is shown. In this embodiment, reamer 300 includes a plurality of blocks 310, with each block 310 having a plurality of blades 320. As illustrated, block 310 includes a first blade 320A and a second blade 320B. Each blade 320 includes a plurality of cutting elements 325. In this embodiment, first blade 320A includes a first arrangement of cutting elements 330A and a second arrangement of cutting elements 330B. First blade 320A includes a first stabilization section 335A disposed proximate and axially above the first arrangement of cutting elements 330A. First blade 320A further includes a second stabilization section 335B disposed proximate and axially above the second arrangement of cutting elements 330B.

The second blade 320B of block 310 also has a third arrangement of cutting elements 340A and a fourth arrangement of cutting elements 340B. Third arrangement of cutting elements 340A are disposed at a axially distal location on blade 320B and a third stabilization section 345A is disposed proximate and axially above the third arrangement of cutting elements 340A. Second blade 320B further includes a fourth arrangement of cutting elements 340B disposed above third stabilization section 345A. Axially above the fourth arrangement of cutting elements 340B, a fourth stabilization section 345B is disposed.

Stabilization sections may be formed from various types of materials, such as tungsten carbide, diamond, and combinations thereof. In certain embodiments, stabilization sections may be formed from diamond impregnated materials. In still other embodiments, the stabilization sections may include a plurality of inserts, such as tungsten carbide inserts, diamond inserts, gauge inserts, wear compensation inserts, depth of cut limiters, and the like.

Figure 4:
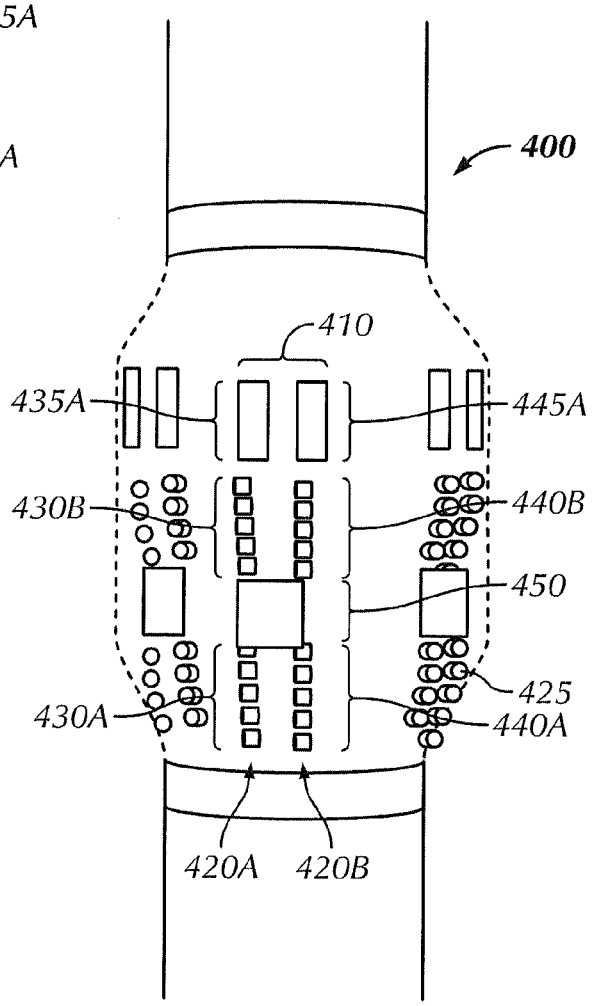
FIG. 4 is a side view of a reamer according to embodiments of the present disclosure.

Referring to FIG. 4, a perspective view of a reamer 400 according to embodiments of the present disclosure is shown. In this embodiment, reamer 400 includes a plurality of blocks 410, with each block 410 having a plurality of blades 420. As illustrated, block 410 includes a first blade 420A and a second blade 420B. Each blade 420 includes a plurality of cutting elements 425. In this embodiment, first blade 420A includes a first arrangement of cutting elements 430A and a second arrangement of cutting elements 430B. First blade 420A includes a first stabilization section 435A disposed proximate and axially above the second arrangement of cutting elements 430B.

The second blade 420B of block 410 also has a third arrangement of cutting elements 440A and a fourth arrangement of cutting elements 440B. Third arrangement of cutting elements 440A is disposed at a axially distal location on blade 420B. Fourth arrangement of cutting elements 440B is disposed on second blade 420B axially above the third arrangement of cutting elements 440A. A second stabilization section 445A is disposed proximate and axially above the fourth arrangement of cutting elements 440B.

In this embodiment, block 410 further includes a third stabilization section 450 disposed axially above first arrangement of cutting elements 430A and third arrangement of cutting elements 440A and axially below second arrangement of cutting elements 430B and fourth arrangement of cutting elements 440B. Third stabilization section 450 may extend partially or completely between first and second blades 420A and 420B.

In still further embodiments, the layout of cutting element arrangements and stabilization sections may be adjusted to optimize drilling. For example, in certain embodiments, one or more additional stabilization sections may be disposed on first blade 420A and/or second blade 420B before the first and second arrangements of cutting elements 430A and 440B, or alternatively, a stabilization second may be disposed to extend partially or completely between first and second blades 420A and 420B, similar to the third stabilization section 450, above. In still other embodiments, rather than have first and second stabilization sections 435A and 445A, reamer 400 may have a stabilization section, similar to third stabilization section 450 disposed above the second and fourth arrangement of cutting elements 430B and 440B, and extending partially or completely between first and second blades 420A and 420B.

Those of ordinary skill in the art will appreciate that by varying the relative location of cutting elements arrangements and stabilization sections, drilling dynamics may be optimized. According to the above described embodiments, the extra stabilization sections, compared to conventional reamers provide extra stabilization that may help to achieve better control of the reamer during drilling. The extra stabilization sections may further help recentralize the reamer/under-reamer with the pilot hole trajectory, thereby decreasing potentially damaging vibrations and improving drilling. Additionally, be dividing the cutting elements into additional cutting element arrangements and removing rock in stages, improved cleaning and cuttings removal may occur. Because the cleaning and cuttings removal is improved, the hydraulics around the cutting elements may be improved, thereby improving cutting element life and thus improving the efficiency of the reamer.

Figure 5:
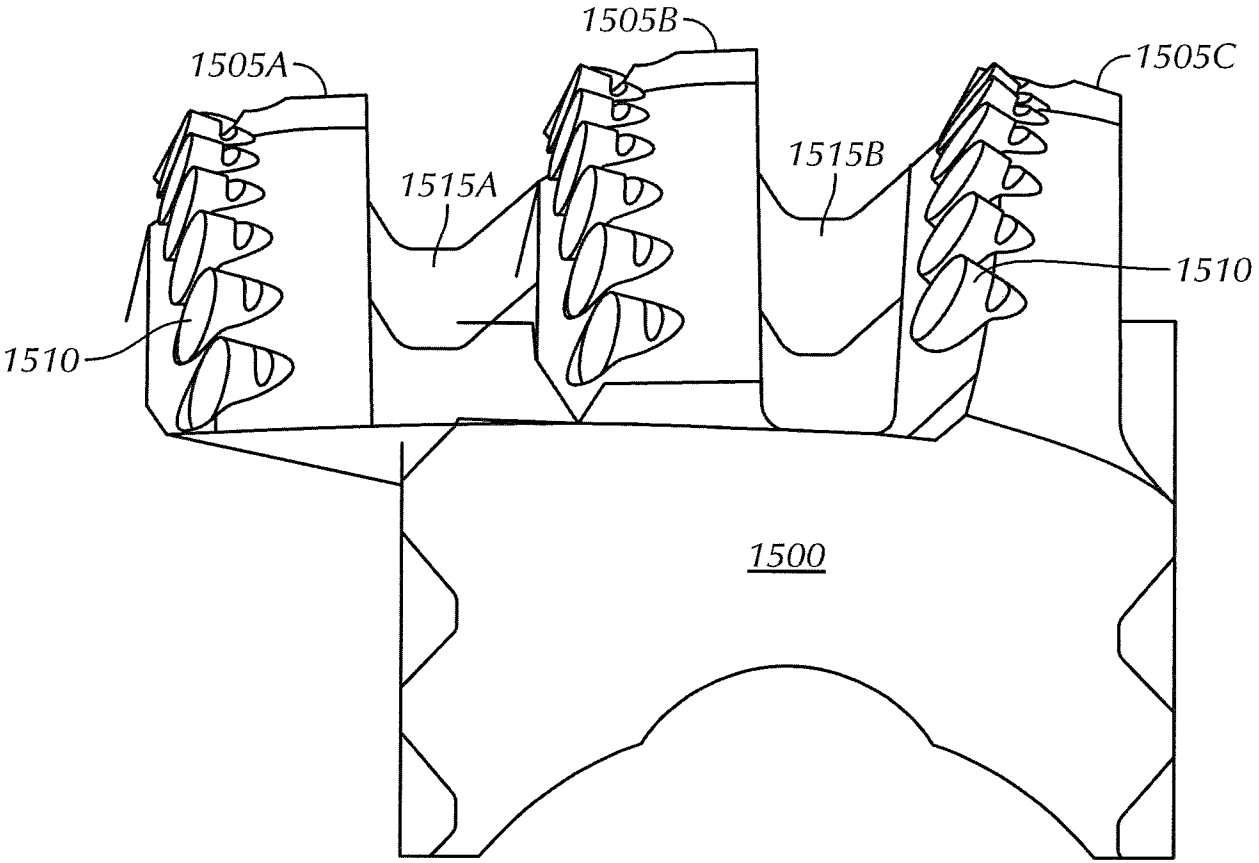
FIG. 5 is an end view of a block of a reamer according to embodiments of the present disclosure.

Referring to FIG. 5, a side view of a block 1500 according to embodiments of the present disclosure is shown. In conventional expandable reamer design, a block consists of one or two blades. However, such symmetrical designs generate harmonics and increase vibrations that may damage the reamer or drilling tool assembly. Block 1500 illustrates an asymmetrical design, wherein block 1500 includes three blades 1505A, 1505B, and 1505C. A plurality of cutting elements 1510 is disposed on each of blades 1505A, 1505B, and 1505C. Flow channels 1515A and 1515B are formed between blades 1505A, 1505B, and 1505C, thereby allowing fluids to flow through remove cuttings dislodged during reaming.

Figure 6:
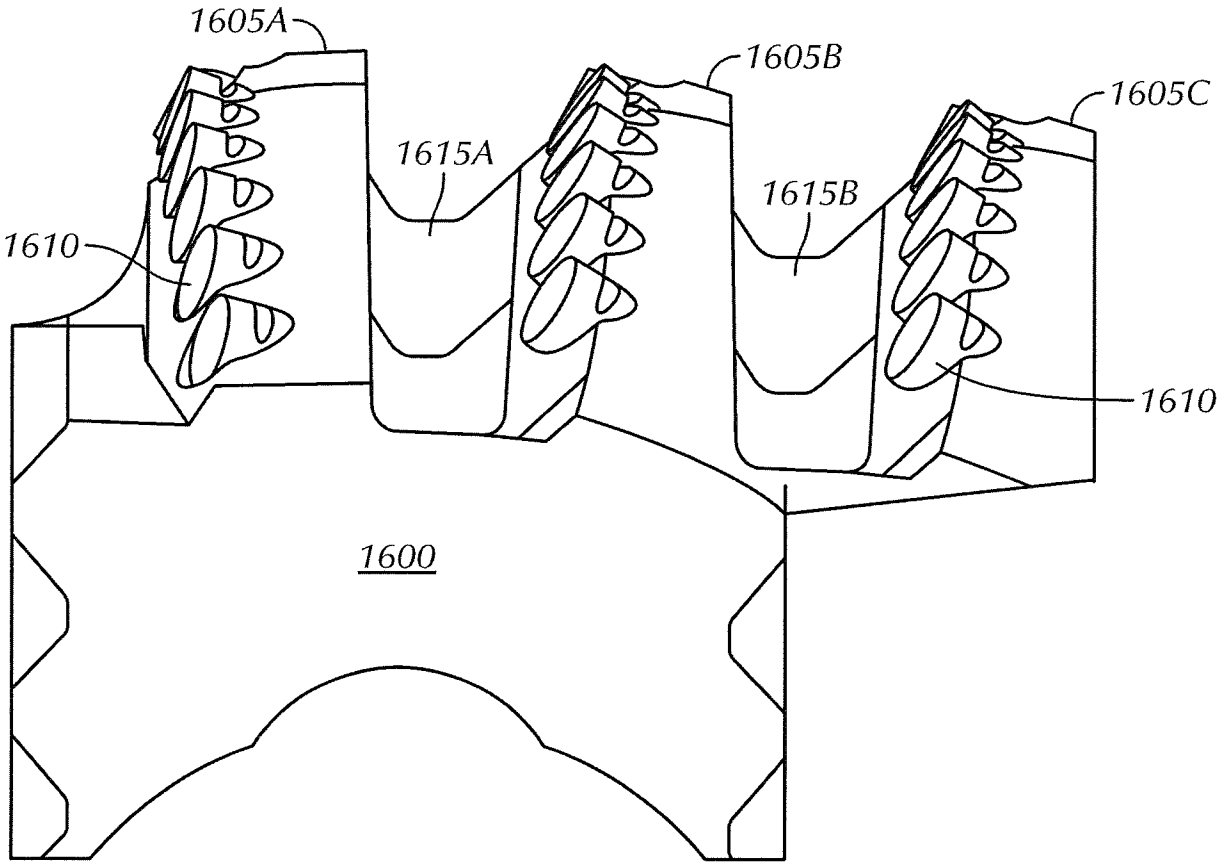
FIG. 6 is an end view of a block of a reamer according to embodiments of the present disclosure.

Referring to FIG. 6, a side view of a block 1600 according to embodiments of the present disclosure is shown. Block 1600 illustrates an asymmetrical design, wherein block 1600 includes three blades 1605A, 1605B, and 1605C. A plurality of cutting elements 1610 is disposed on each of blades 1605A, 1605B, and 1605C. Flow channels 1615A and 1615B are formed between blades 1605A, 1605B, and 1605C, thereby allowing fluids to flow through remove cuttings dislodged during reaming.

Referring to FIGS. 5 and 6 together, FIG. 5 specifically shows a block 1500 with a forward set asymmetrical blade configuration. In such a configuration, the leading blade 1505A extends outwardly from the block 1500. In another embodiment illustrated in FIG. 6, block 1600 has a reverse set asymmetrical blade configuration, wherein the trailing blade 1605C extends outwardly from the block 1600. In both embodiments, the blades 1505 and 1605 are asymmetrical with respect to the block center, which breaks up harmonics and reduces reamer vibrations.

Those of ordinary skill in the art will appreciate that the amount the blades 1505 and 1605 are offset from the bit center will depend on the specific requirements of the reaming operation. Additionally, in certain embodiments, more than three blades 1505 and 1605 may be used, for example, in alternate embodiments, four, five, or more blades 1505 and 1605 may be used. Those of ordinary skill in the art will appreciate that the number of blades 1505 and 1605 per block 1500 and 1600 may vary depending on the diameter of the reamer on which the blocks are installed. Thus, smaller diameter reamers may have blocks 1500 and 1600 carrying less blades 1505 and 1605 than relatively larger diameter reamers.

Figure 7:
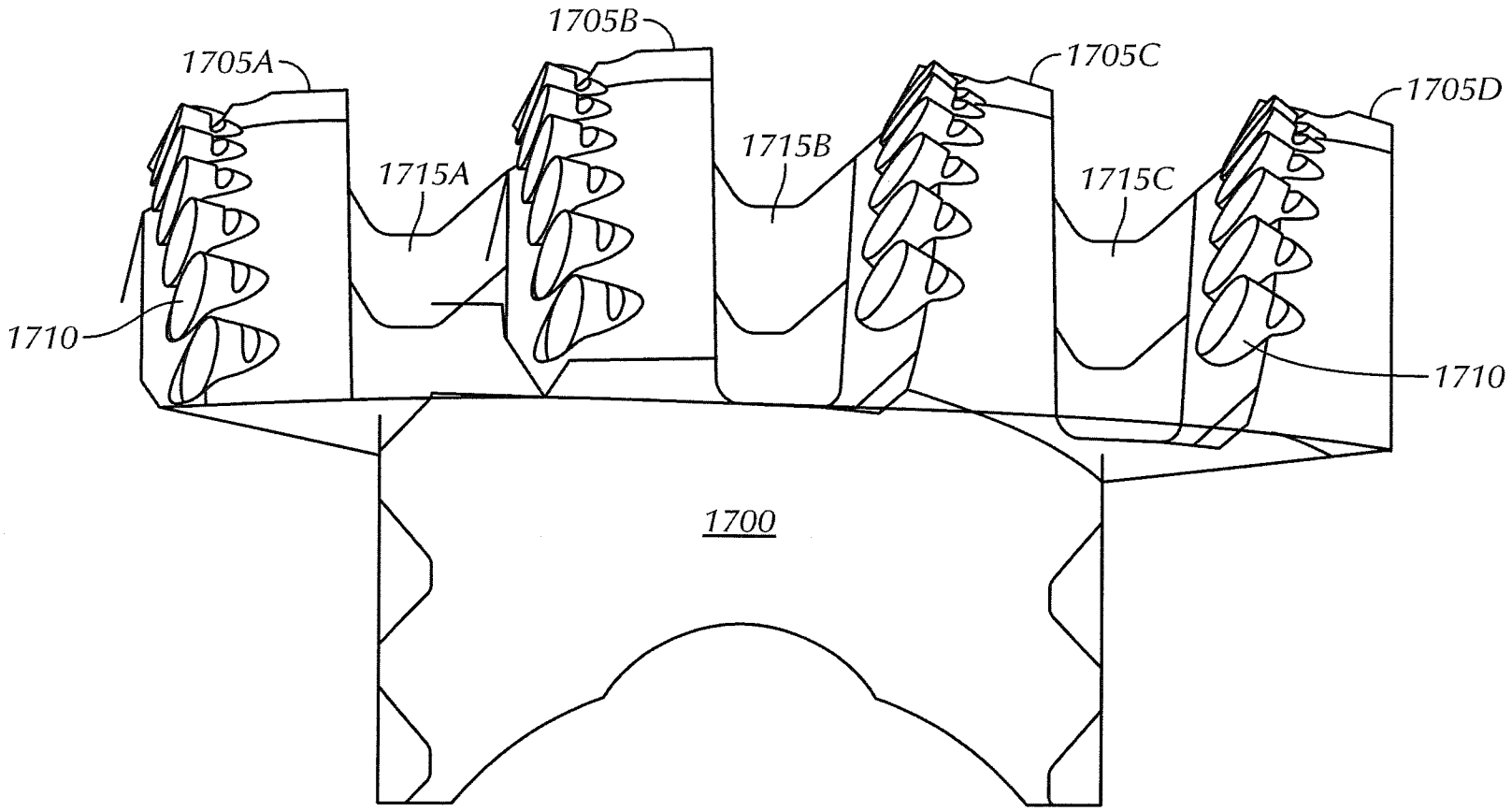
FIG. 7 is an end view of a block of a reamer according to embodiments of the present disclosure.

Referring to FIG. 7, a side view of a block 1700 in accordance with embodiments of the present disclosure is shown. In this embodiment, block 1700 illustrates a symmetrical blade configuration, wherein the block 1700 has four blades 1705A-D. Flow channels 1715A-1715C are formed between blades 1705A-D, and a plurality of cutting elements is disposed on each of blades 1705A-D. The symmetrical blade configuration of FIG. 7 illustrates an expanded cutting structure, as the cutting structure extends beyond an open slot in the reamer body. Expanded cutting structure increases the volume of diamond without compromising the cutting structure cleaning efficiency. Thus, a greater volume of diamond may allow for better rock removal, decreased cutter wear, and improved hydraulics.

Conventional expandable reamers included an open slot configured to receive the block when the reamer was in a compressed condition. During use, the block radially expands out of the slot into engagement with the formation, as described above. Embodiments of the present disclosure provide for a reamer having an open slot, such that in a compressed condition, the block is retracted into the open slot along with center blades 1705B and 1705C, while outer blades 1705A and 1705D are retracted into the body of the tubular, thereby allowing the reamer to be run into a wellbore. Upon actuation of the reamer, the block expands radially, thereby expanding all four blades 1705A-D into contact with the formation. As explained above, the increased diamond volume may allow for more efficient removal of rock, while the increased number of channels 1715A-C allows for efficient cleaning of the cutting structure. Those of ordinary skill in the art will appreciate that the size, i.e., length, of the expanded cutting structure may be optimized to have the most cutting elements, and thus diamond, possible while making the expanded cutting structure as short as possible, in order to provide for a more stable reamer.

Figure 8:
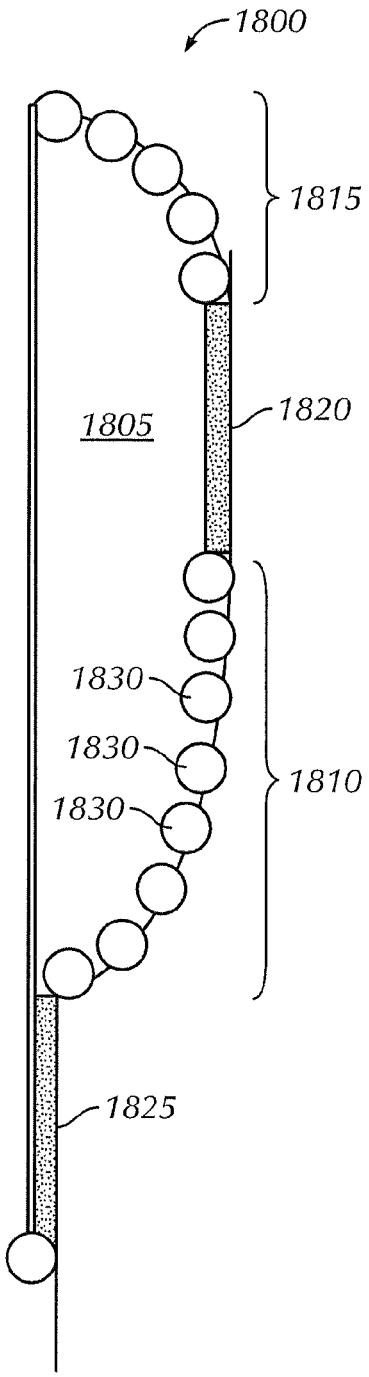
FIG. 8 is a side view of a reamer according to embodiments of the present disclosure.

Referring to FIG. 8, a side view of a reamer according to embodiments of the present disclosure is shown. In this embodiment, a reamer 1800 having a blade 1805 is illustrated. Blade 1805 has a first arrangement of cutting elements 1810 and a second arrangement of cutting elements 1815. Blade 1805 also has a stabilization section 1820. Blade 1805 also has a second stabilization section 1825, which is a pilot conditioning section. The second stabilization section 1825 provides a gage surface that offsets bending moments exerted by the reamer cutting structure during reaming. Additionally, second stabilization section 1825 helps to reduce excessive cutter loading and resultant vibrations that may damage the cutting structure or otherwise result in less efficient reaming.

Figure 9:
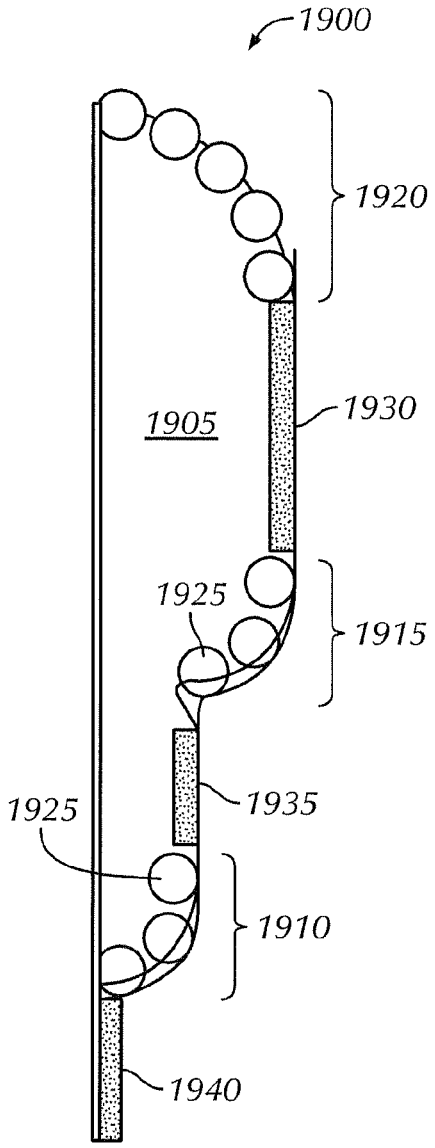
FIG. 9 is a side view of a reamer according to embodiments of the present disclosure.

Referring to FIG. 9, a side view of a reamer according to embodiments of the present disclosure is shown. In this embodiment, a reamer 1900 having a blade 1905 is illustrated. Blade 1905 has a first arrangement of cutting elements 1910, a second arrangement of cutting elements 1915 that extends radially further than the first arrangement of cutting elements 1910, and a third arrangement of cutting elements 1920. Each arrangement of cutting elements 1910, 1915, and 1920 have a plurality of cutting elements 1925 disposed thereon. Blade 1905 has a first stabilization section 1930 disposed below the third arrangement of cutting elements 1920 and above the second arrangement of cutting elements 1915. Blade 1905 also has a second stabilization section 1935 disposed between the second cutting elements arrangement 1915 and the first cutting element arrangement 1910, and a third stabilization section 1940 disposed below the first cutting elements arrangement 1910.

Reamer 1900 illustrates a reamer having multiple stage reaming blades 1905. Reamer 1900 includes three areas of stabilization, 1930, 1935, and 1940. Thus, during drilling, third stabilization section 1940 contacts the wellbore wall as the first arrangement of cutting elements 1910 engages formation. As the diameter of the wellbore increases as a result of the first arrangement of cutting elements 1910 drilling the formation, second stabilization section 1935 contacts the enlarged portion of the wellbore, thereby stabilizing the reamer 1900, such that when the second arrangement of cutting elements 1915 engages the formation, cutter loading and vibrations are reduced. The second arrangement of cutting elements 1915 may then drill the formation, expanding the wellbore to a final diameter. When the diameter of the wellbore is increased to a final diameter, the first stabilization section 1930 may contact the wall of the wellbore, thereby further stabilizing the reamer 1900, further increasing the efficiency of the reaming operation.

Those of ordinary skill in the art will appreciate that in certain embodiments, reamer 1900 may have more than two stages. For example, reamer 1900 may have a third stage, wherein the third arrangement of cutting elements 1920 extends radially further than the second arrangement of cutting elements 1915. Such an embodiment may allow the diameter of the wellbore to be increased to a larger diameter in three stages. Reaming in stages allows the reamer 1900 to be stabilized at the cutting structure level, thereby reducing the magnitude of imbalance forces, damaging vibrations, and excessive cutter loading.

Figure 10A:
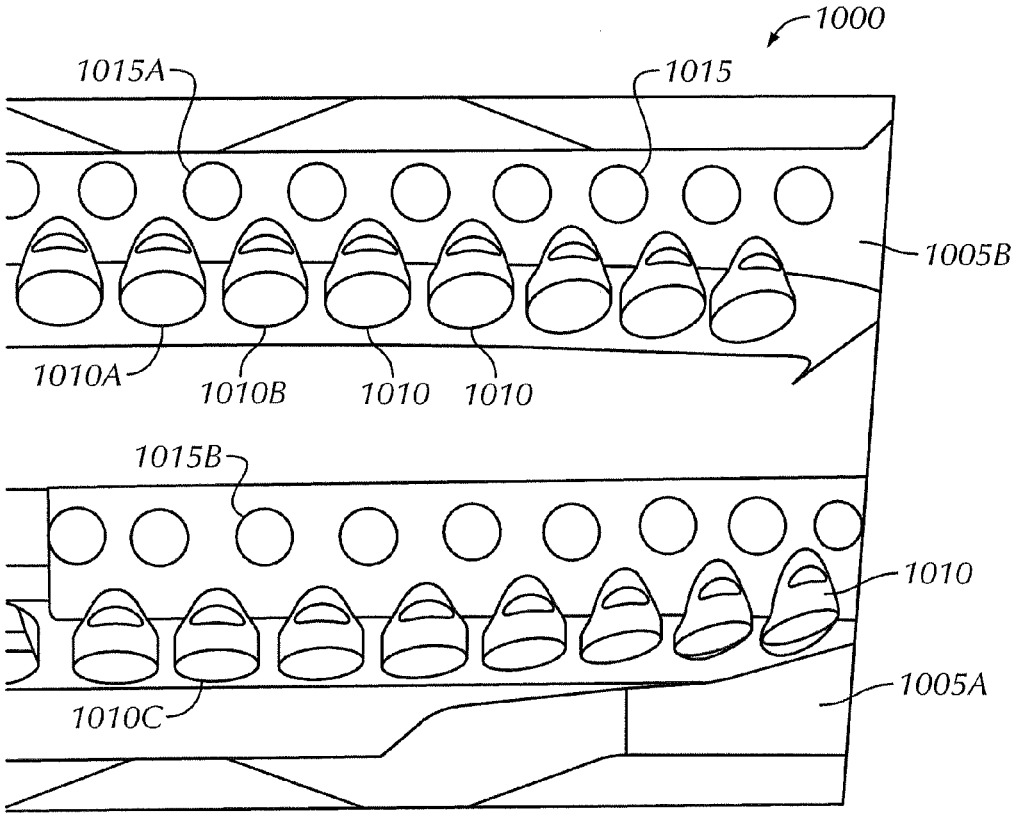
FIG. 10A is a top view of a reamer block according to embodiments of the present disclosure.
Figure 10B:
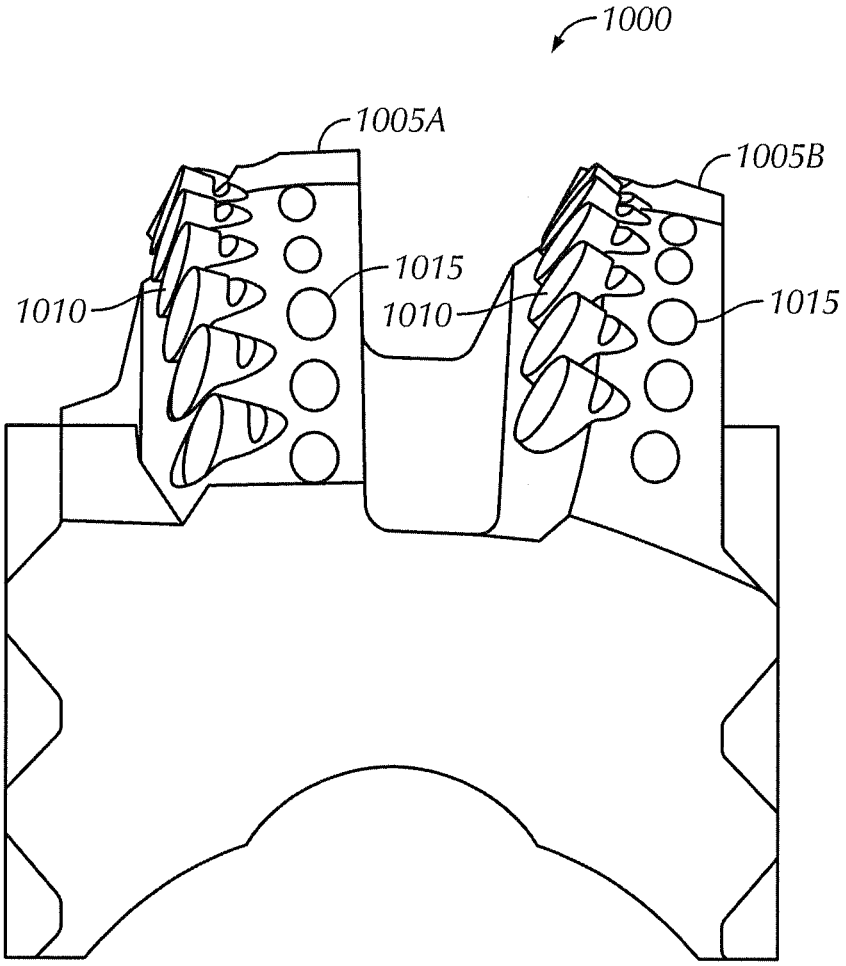
FIG. 10B is an end view of a reamer block according to embodiments of the present disclosure.

Referring to FIGS. 10A and 10B, a top view and side view, respectively, of a reamer block according to embodiments of the present disclosure is shown. In this embodiment, a block 1000 is shown having two blades 1005A and 1005B. Each blade 1005A and 1005B has a plurality of cutting elements 1010 disposed thereon. Each blade 1005A and 1005B also has a plurality of depth of cut limiters 1015 disposed thereon. As illustrated, the depth of cut limiters 1015 are disposed behind the cutting elements 1010 on each blade 1005A and 1005B. While depth of cut limiters may engage the formation at some point during drilling, they do not actively cut the formation, rather, the depth of cut limiters may prevent damage to blades 1005 and or cutting elements 1010 from inadvertent blade 1005 to sidewall contact. The depth of cut limiters 1015 may be formed from various materials including, for example, tungsten carbide, diamond, and combinations thereof. Additionally, depth of cut limiters 1015 may include inserts with cutting capacity, such as back up cutters or diamond impregnated inserts with less exposure than primary cutting elements 1015, or diamond enhanced inserts, tungsten carbide inserts, or other inserts that do not have a designated cutting capacity. While depth of cut limiters 1015 do not primarily engage formation during drilling, after wear of the cutting elements 1010, depth of cut limiters 1015 may engage the formation to protect the cutting elements 1010 from increased loads as a result of worn cutting elements 1010.

After depth of cut limiters 1015 engage formation, due to wear of the cutting elements 1010, the load that would normally be placed upon the cutting elements 1010 is redistributed, and per cutter force may be reduced. Because the per cutter force may be reduced, cutting elements 1010 may resist premature fracturing, thereby increasing the life of the cutting elements 1010. Additionally, redistributing cutter forces may balance the overall weight distribution on the cutting structure, thereby increasing the life of the tool. Furthermore, depth of cut limiters 1015 may provide dynamic support during wellbore enlargement, such that the per cutter load may be reduced during periods of high vibration, thereby protecting cutting elements 1010. During periods of increased drill string bending and off-centering, depth of cut limiters 1015 may contact the wellbore, thereby decreasing lateral vibrations, reducing individual cutter force, and balancing torsional variation, so as to increase durability of the secondary cutting structure and/or individual cutting elements 1010.

Figure 10C:
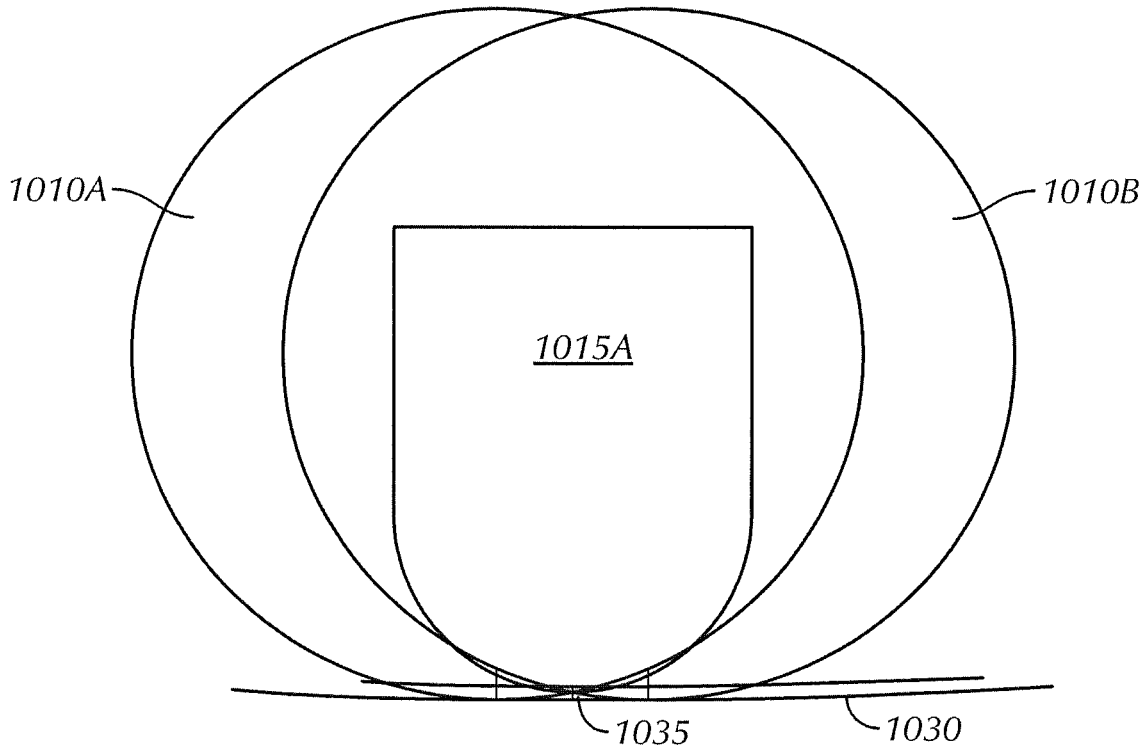
FIG. 10C is a close-perspective representation of the reamer of FIGS. 10A and 10B according to embodiments of the present disclosure.

As shown specifically in FIG. 10A, the depth of cut limiters 1015 are positioned between adjacent cutting elements. More specifically, the depth of cut limiter 1015A is disposed between the apex of adjacent cutting elements 1010A and 1010B. Said another way, depth of cut limiter 1015A is circumferentially offset from adjacent cutting elements 1010A and 1010B. By disposing the depth of cut limiter 1015A between cutting elements 1010A and 1010B, the depth of cut limiters are configured to ride on a formation ridge generated between cutting elements 1010A and 1010B. Referring briefly to FIG. 10C, a close-perspective representation of the reamer of FIGS. 10A and 10B, according to embodiments of the present disclosure is shown. FIG. 10C illustrates cutting elements 1010A, 1010B, and depth of cut limiter 1015A. As cutting elements 1010A and 1010B contact formation 1030, an undrilled ridge 1035 forms therebetween. In the event of a sudden excessive weight-on-bit transfer to the reamer, depth of cut limiter 1015A contacts the ridge 1035, thereby reducing the magnitude of peak torque generated and limit damage to cutting elements 1010A and 1010B. Additionally, because depth of cut limiter ridge on ridge 1035, excessive reamer vibration may be prevented, which may prevent damage to other components of the reamer.

Referring back to FIGS. 10A and 10B, in alternate embodiments a depth of cut limiter 1015 may be disposed on a blade in alignment with a cutting element of a different blade. For example, depth of cut limier 1015B of blade 1005A is aligned with cutting elements 1010B of blade 1005B. In another embodiment, depth of cut limiter 1015A of second blade 1005B may be aligned with cutting element 1010C for first blade 1005A.

In still other embodiments, at least one depth of cut limiter may be disposed so as to overlap with at least one cutting element. For example, depth of cut limiter 1015A may be disposed to overlap with cutting element 1010A and/or cutting elements 1010C. In certain embodiments, the overlap may be limited to a certain diameter of the cutting element. For example, the overlap may be less than fifty percent of the diameter of at least one cutting elements. In other embodiments, the overlap may be forty percent, thirty percent, twenty-five percent, twenty percent, or less.

Advantageously, embodiments of the present disclosure may provide enhanced reamer block, blade, and cutting structure design to improve the operation of the reamer. Those of ordinary skill in the art will appreciate that the above identified methods for reducing vibrations, reducing magnitude of peak torque generated during excessive weight-on-bit transfer, offsetting bending moments, and reducing excessive cutter loading may be used alone or combined.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A secondary cutting structure for use in a drilling assembly, the secondary cutting structure comprising:

a tubular body; and a block, extendable from the tubular body, the block comprising:

a first arrangement of cutting elements disposed on a first blade;

a first stabilization section disposed on the first blade and proximate the first arrangement of cutting elements;

a second arrangement of cutting elements disposed on the first blade; and a second stabilization section disposed on the first blade and proximate the second arrangement of cutting elements.

2. The secondary cutting structure of claim 1, wherein the block further comprises:

a third arrangement of cutting elements disposed on a second blade;

a third stabilization section disposed proximate the third arrangement of cutting elements;

a fourth arrangement of cutting elements disposed on the second blade; and a fourth stabilization section disposed proximate the fourth arrangement of cutting elements.

3. The secondary cutting structure of claim 1, wherein the block further comprises a second blade and wherein the first stabilization section extends between the first blade and the second blade.

4. The secondary cutting structure of claim 3, wherein the second stabilization section extends between the first blade and the second blade.

5. The secondary cutting structure of claim 1 wherein the block further comprises:

an arrangement of cutting elements disposed on a second blade; and a third arrangement of cutting elements disposed on a third blade.

6. The secondary cutting structure of claim 5, wherein the third blade is asymmetrically offset with respect to a central axis of the block.

7. The secondary cutting structure of claim 6, wherein the third blade is axially offset in a forward position.

8. The secondary cutting structure of claim 5, wherein the third blade is axially offset in a reverse position.

9. The secondary cutting structure of claim 5, wherein the block further comprises:

a fourth arrangement of cutting elements disposed on a fourth blade.

10. A secondary cutting structure for use in a drilling assembly, the secondary cutting structure comprising:

a tubular body; and a block, extendable from the tubular body, the block comprising:

a first arrangement of cutting elements disposed on a first blade;

a first stabilization section disposed on the first blade and proximate the first arrangement of cutting elements;

a second arrangement of cutting elements disposed on the first blade; and a second stabilization section disposed on the first blade and proximate the second arrangement of cutting elements; and at least one depth of cut limiter disposed intermediate the apex of at least two adjacent cutting elements.

11. The secondary cutting structure of claim 10, wherein the block further comprises:

a plurality of cutting elements disposed on a second blade; and at least one depth of cut limiter disposed intermediate the apex of at least two adjacent cutting elements of the second plurality of cutting elements.

12. The secondary cutting structure of claim 11, wherein the at least one depth of cut limiter of the first blade is in alignment with at least one cutting element of the second blade.

13. The secondary cutting structure of claim 10, wherein the at least one depth of cut limiter overlaps with at least one cutting element.

14. The secondary cutting structure of claim 13, wherein the overlap comprises less than 50 percent of the diameter of the at least one cutting element.

15. The secondary cutting structure of claim 10, wherein the at least one depth of cut limiter is circumferentially offset from the two adjacent cutting elements.

* * * * *